United States Patent [19]

Wallow et al.

[11] Patent Number: 4,671,180

[45] Date of Patent: Jun. 9, 1987

[54] ARMOR-PIERCING INERTIAL PROJECTILE

[75] Inventors: Peter Wallow, Dusseldorf; Bernhard Bisping, Ratingen, both of Fed. Rep. of Germany

[73] Assignee: Rheinmetall GmbH, Duesseldorf, Fed. Rep. of Germany

[21] Appl. No.: 717,463

[22] Filed: Mar. 27, 1985

Related U.S. Application Data

[63] Continuation of Ser. No. 308,199, Sep. 24, 1981, abandoned.

[30] Foreign Application Priority Data

Sep. 27, 1980 [DE] Fed. Rep. of Germany ..... 3036463

[51] Int. Cl.[4] ..... F42B 10/00

[52] U.S. Cl. ..... 102/517; 102/703

[58] Field of Search ..... 102/517–519, 102/506, 703

[56] References Cited

U.S. PATENT DOCUMENTS

| | | | |
|---|---|---|---|
| 740,849 | 10/1903 | Groff | 102/519 |
| 1,017,928 | 2/1912 | Tocik | 102/506 |
| 1,305,967 | 6/1919 | Hawks | 102/494 |
| 3,213,792 | 10/1965 | Gremander et al. | 102/518 |
| 4,098,194 | 7/1978 | Miller et al. | 102/293 |
| 4,108,072 | 8/1978 | Trinks et al. | 102/518 |
| 4,353,305 | 10/1982 | Moreau | 102/519 |

FOREIGN PATENT DOCUMENTS

| | | | |
|---|---|---|---|
| 314680 | 10/1919 | Fed. Rep. of Germany | 102/491 |
| 75101 | 3/1961 | France | 102/491 |
| 10991 | of 1914 | United Kingdom | 102/517 |
| 579205 | 7/1946 | United Kingdom | 102/517 |

*Primary Examiner*—Harold J. Tudor

[57] ABSTRACT

An improved armor-piercing inertial penetrator projectile having a prepenetrator which has a substantially uniform flight diameter D, over substantially its entire length. A prepenetrator assembly is formed by a plurality of elements which are adapted to interact with the material of the corresponding target upon impact so as to form an effective surface which has a diameter larger by a predetermined amount than the flight diameter D of the prepenetrator.

4 Claims, 8 Drawing Figures

ARMOR-PIERCING INERTIAL PROJECTILE

This application is a continuation application of Ser. No. 308,199 filed Sept. 24, 1981, now abandoned.

BACKGROUND OF THE INVENTION

The invention relates to an armor-piercing inertial projectile (hyper-velocity kinetic energy penetrator projectile) with a prepenetrator, which has a substantially uniform diameter over its entire length.

Such type projectile is, for example, described in U.S. Pat. No. 4,098,194.

The effect of the penetrator on an inclined armored plate was determined to be such that the axis of a penetration channel, which is formed at impact extends in proximity to the surface normal and therefore encompasses an angle with the firing direction of the projectile. This causes penetrators made of steel to bend and with heavy metal penetrators to break up or disintegrate which detracts significantly from the target effectiveness of the corresponding penetrator when impacting on a multi-plate armored target.

SUMMARY OF THE INVENTION

It is an object of this invention to avoid the interaction between an inertial project and an armored plate which causes bending and breaking of the projectile and to thereby improve the penetration capabilities of the corresponding penetrator.

BRIEF DESCRIPTION OF THE DRAWINGS

The invention is further set forth in the following detailed description of three embodiments of penetrator projectiles which are shown by way of example only in the accompanying drawings and by means of which the invention will be clearly understood.

DETAILED DESCRIPTION

Figure 1:
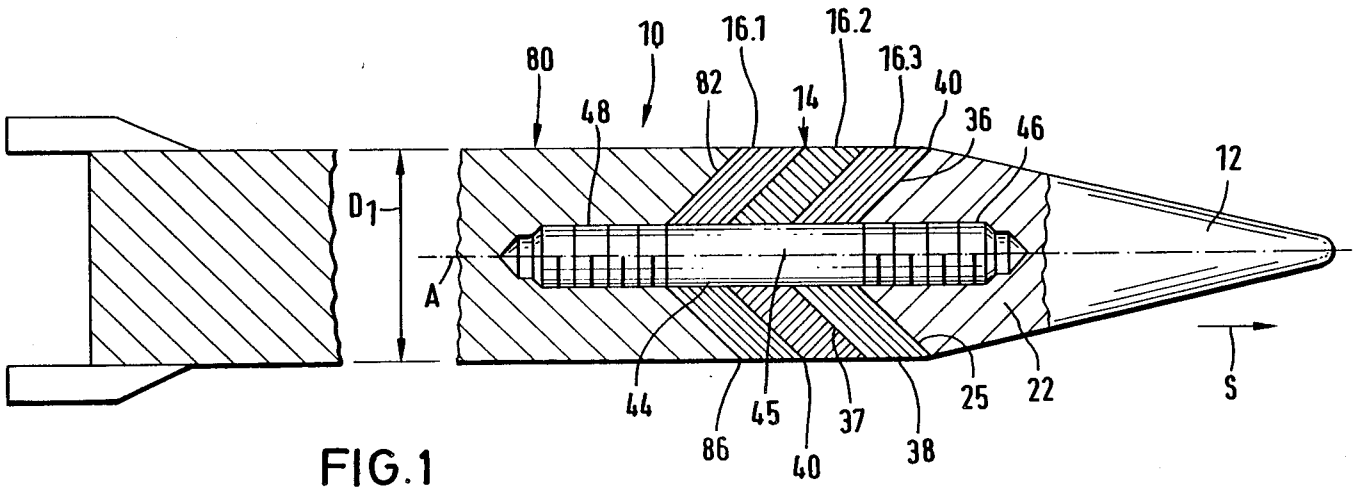
FIGS. 1 and 2 illustrate in longitudinal partial cross-section a first and second embodiment of the penetrator projectile of the invention in which there are included a set of first elements.

According to FIG. 1 there is illustrated an inertial projectile having a longitudinal axis A and a pre-penetrator 10 with a nose 12 and an intermediate region and at the rear of which a region 80 is disposed to which a not further illustrated and described main penetrator adjoins. The pre-penetrator 10 has a projectile diameter $D_1$ (hereinafter referred to as the flight diameter) and is provided with a nose body 22, the rear portion of which is formed as a frusto-conical surface 25. In the intermediate region between the nose 12 and the region 80 there are disposed a plurality of funnel-shaped first elements 16.1, 16.2, 16.3. The element 16.3 is matingly adapted with its funnel-shaped front surface 36, defined by a cutting edge 40, to the frusto-conical surface 25 and directly adjoins the latter. With a predetermined wall thickness the element 16.3 defines at its rear side a frusto-conical surface 37; there follow still two further similarly shaped first elements, that is element 16.2 and 16.1. All three first elements 16 form a stack. The rear most element 16.1 adjoins at its rear side directly a funnel-shaped front surface 82 of the penetrator region 80. In the region of longitudinal axis A there is provided an axial connecting element 44, for example a stay bolt, which is provided with a front threaded portion 46 and a rear threaded portion 48. The rear threaded portion 48 connects the stay bolt 44 with the main penetrator, whereas the front threaded portion 46 is screwed on to the nose body 22. The shaft 45 of the stay bolt 46 extends through the central opening (not illustrated in detail) of the elements 16 . . . , whereby the stack of elements 16 . . . , is fixed in the intermediate region.

When impacting a conventionally inclined armored plate of a multi-layer target there is formed the first portion of a penetration channel by means of the nose body 22. As soon as the element 16.3 contacts with its cutting edge 40 the target material of a corresponding armor plate, it spreads out in view of its shape, whereby its effective diameter increases relative to the main diameter $D_1$. The elements 16.2 and 16.1 behave correspondingly and ensure thereby that a sufficiently large penetration channel and exit-crater are achieved in the corresponding target plate, so that the following main penetrator is not hindered and consequently can become target effective in accordance with its hyper-velocity as well as also its mass to impart increased kinetic energy against the following target plate(s).

Figure 2:
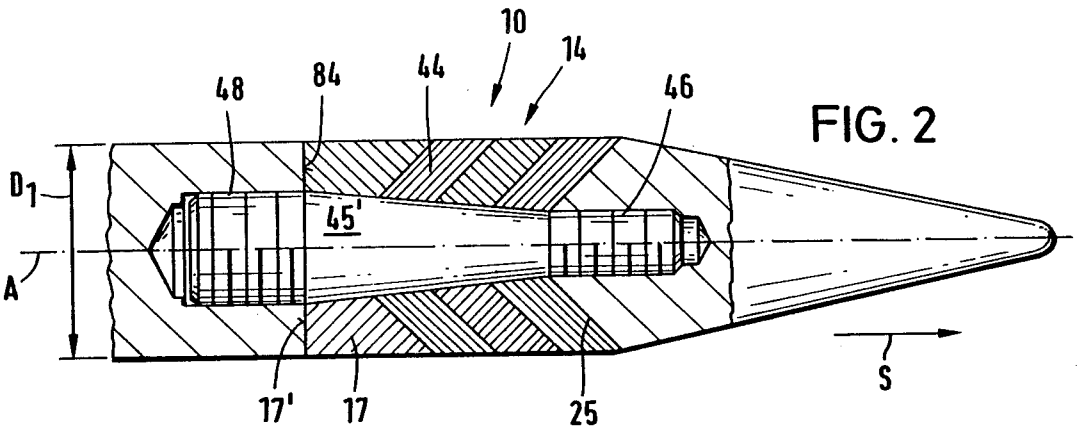

The embodiment of FIG. 2 differentiates itself from the embodiment of FIG. 1 in that the portion 451 which extends between the threaded parts 46 and 48 of the stay bolt 44 is of frusto-conical shape and in that an element 17 is provided, which abuts with a flat plan rear surface $17^1$ against a front end surface 84 of the region 80.

The elements 16 . . . , whose number can be predetermined, can be adapted to different targets and be made out of different material and can have different wall thicknesses.

Figure 3:
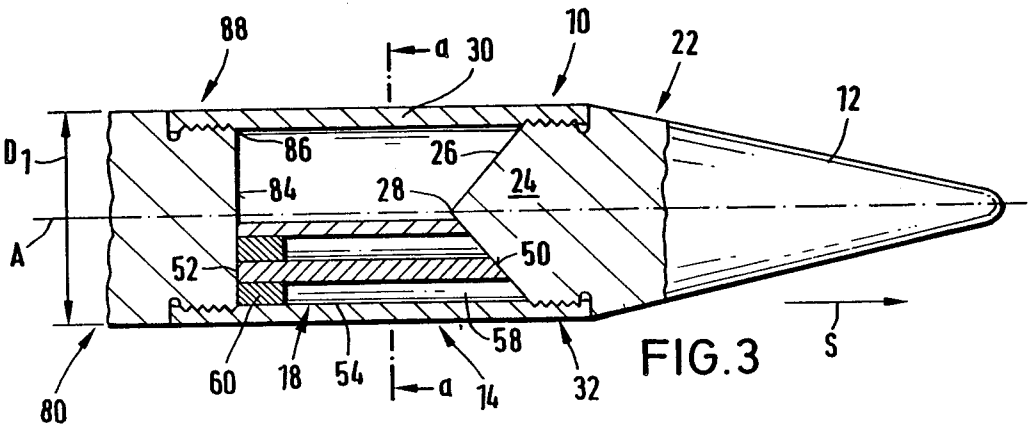
FIGS. 3, 4 and 5 illustrate in partial longitudinal cross-section a third, fourth, and fifth embodiment of the penetrator projectile of the invention in which second and third elements are disposed.
Figure 3A:
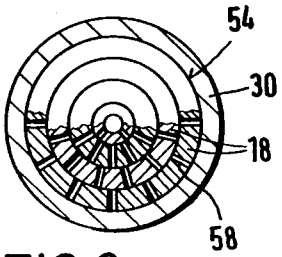
FIGS. 3*a*, 4*a*, and 5*a* are cross-sectional views along lines a—a in the corresponding FIG. 3, 4 or 5.

The embodiment of FIGS. 3 and 3*a* includes two pipe-shaped elements 18. A plurality of pipes with corresponding different exterior diameters are coaxially arranged. These pipes abut with their rear sides 52 against the flat front end surface 84 of the region 80 and are adapted to bear according to their lengths with their forward sides 50 against the conical surface 26 for mutual bracing. The elements 18 have a plurality of slits 58 which extend in the longitudinal direction from the front side 50 to the rear-sided annular region 60. The outer element 18 is surrounded at its outer periphery by a jacket 30, the inner surface of which is not designated with a reference number and is immediately adjacent to the peripheral surface 54 on the outer element 18. The jacket 30 is joined with the nose body 22 in a forward connection zone 32 and with the rear-sided adjoining penetrator region 80 at a rear-sided connecting zone 88 in a manner only schematically illustrated and not described in detail. In this manner all corresponding parts are arranged and fixed with respect to each other in a predetermined manner.

When impacting on a conventional inclined armor plate of a multi-layer target there is again formed the first portion of the penetration channel by means of the nose body 22. The jacket 30 tears and, as a result of the movement of the surface 84 in the firing direction, the elements 18 are repelled by the frustoconical surface 26 in such a way that they move with their forward sides 50, due to inter-action with the material of the target to spread out and form a corresponding effective surface of increased diameter with respect to the flight diameter $D_1$.

Figure 4:
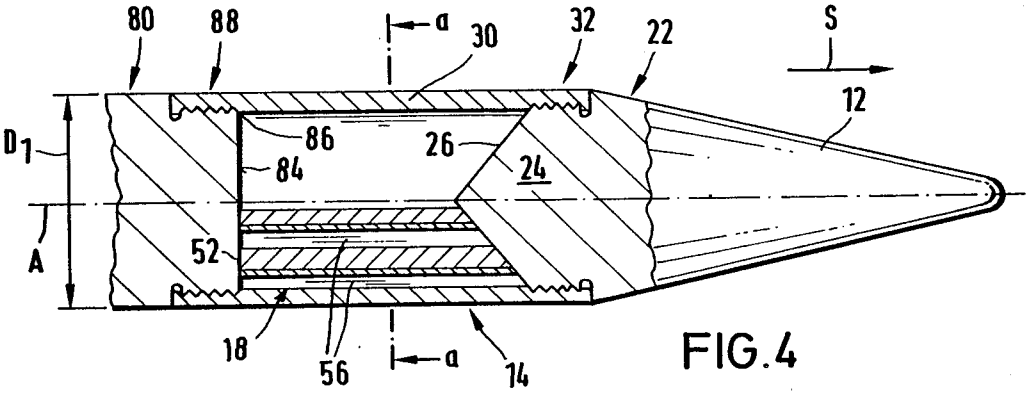
Figure 4A:
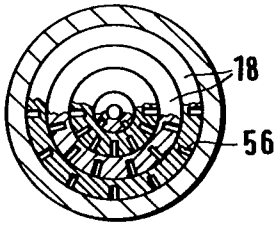

In the embodiment in accordance with FIGS. 4 and 4*a* the aforedescribed slits 58, which were described in connection with FIGS. 3 and 3*a*, are replaced by means of grooves 56, which extend however over the entire length of each element 18. Each groove 56 forms a fracture zone, so that upon impacting the target by the corresponding pre-penetrator the breaking of the fracture zones causes the guiding of the elements 18 outwardly via a sliding on the conical surface 26 of the cone 24 causing a spreading out of such elements and achieving the previously described effect.

Figure 5:
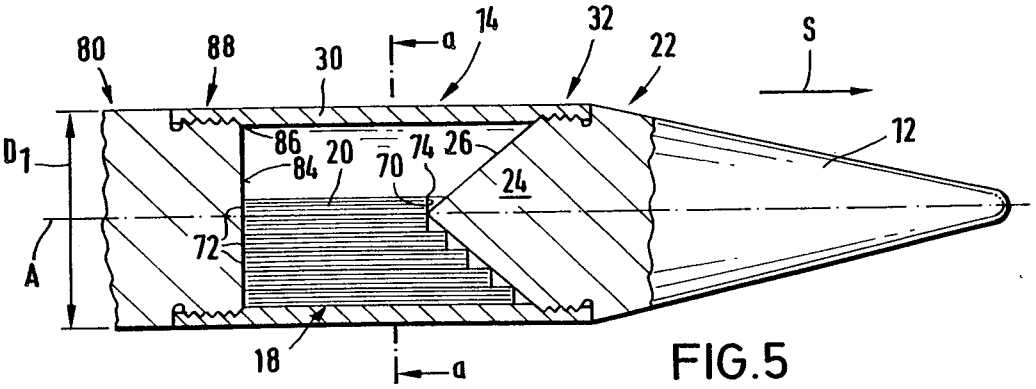
Figure 5A:
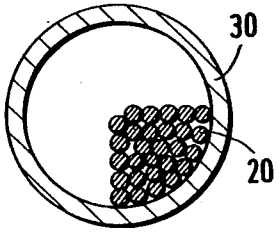

In the embodiment of FIGS. 5 and 5*a* a bundle of rod-shaped third elements 20 are surrounded in a region of a prepenetrator 10 by a jacket 30 and are joined with the region 80 of the main penetrator as will be described hereinafter. The nose body 22 which is fixedly supported by the jacket 30 has again at its rear side a cone 24. The elements 20 bear with their rear-side ends 72 against the flat end-face 84 of the region 80 and bear with their forward ends 70 against the conical surface 26 of the cone 24. Upon impacting a conventionally inclined armor plate of a multi-layered target there is again formed a first portion of the penetration channel by the nose body 22. The jacket 30 tears or breaks and due to the movement of the surface 84 in the direction of firing S the rods 20 are repelled in such a way by the conical surface 26 that they move with their forward ends 70 having the cutting edges 74, by inter-action with the material of the target, to form an effective surface of an enlarged diameter with respect to the flight diameter $D_1$.

Although the invention is illustrated and described with reference to a plurality of embodiments thereof, it is to be expressly understood that it is in no way limited to the disclosure of such preferred embodiments but is capable of numerous modifications within the scope of the appended claims.

We claim:

1. An improved armor-piercing fin-stabilized penetrator projectile having a large length to diameter ratio and having (a) a metallic rear main body (b) a metallic middle body and (c) a pointed front nose body the diameter of the middle body is equal to the diameter of the main body and said three bodies are coaxially mounted one behind the other to form an assembled penetrator projectile, said main body and nose body have mutually confronting threaded blind bores and said middle body has a through bore disposed in coaxial alignment therebetween, an axial threaded connecting bolt being threadably mounted at opposite ends thereof in said blind bores and extending through said through-bore to maintain said penetrator projectile in an assembled state, said nose body having an inwardly rearwardly tapered conically shaped portion, said middle body being formed by a plurality of juxtaposed armor-piercing partial cores which have mutually contacting conical surfaces forming an essentially conically shaped forwardly facing recess which matingly confronts said rearwardly tapered portion of said nose body forming an essentially rearwardly facing conically shaped projection; said main body presenting an essentially flat circular forwardly facing end face and said plurality of juxtaposed partial cores presenting a mating rearwardly facing flat circular abutting surface, whereby due to the inertial forces of the penetrator projectile in flight a force component is imparted by the main body on said plurality of partial cores on impact which causes said partial cores to impart via their mutually contacting surfaces a force component on the main body in a direction transverse relative to the longitudinal axis of the penetrator projectile to thereby enlarge the penetration channel in the target to a size which is larger than the maximum cross-section of the projectile and thereby facilitates the penetration of the penetrator projectile into the target.

2. The improved armor-piercing fin-stabilized penetrator projectile as set forth in claim 1, wherein said plurality of partial cores are adapted to interact with the material of the corresponding target.

3. The improved armor-piercing inertial penetrator projectile as set forth in claim 1, wherein said plurality of partial cores have different wall thicknesses.

4. The improved armor-piercing inertial penetrator projectile as set forth in claim 1, wherein said elements of said plurality of elements are made of different materials.

* * * * *